US005237307A

United States Patent [19]

Gritton

[11] Patent Number: 5,237,307

[45] Date of Patent: Aug. 17, 1993

[54] NON-CONTACT TAMPER SENSING BY ELECTRONIC MEANS

[75] Inventor: Dale G. Gritton, Pleasanton, Calif.

[73] Assignee: The United States of America as represented by the United States Department of Energy, Washington, D.C.

[21] Appl. No.: 799,441

[22] Filed: Nov. 27, 1991

[51] Int. Cl.[5] ..... G08B 13/22

[52] U.S. Cl. ..... 340/572; 324/660; 324/661; 324/662; 340/551; 340/568

[58] Field of Search ..... 340/572, 551, 568; 324/660, 661, 662

[56] References Cited

U.S. PATENT DOCUMENTS

| | | | |
|---|---|---|---|
| 3,857,092 | 12/1974 | Meyer | 324/662 |
| 3,932,857 | 1/1976 | Way et al. | 340/572 |
| 3,974,581 | 8/1976 | Martens et al. | 340/572 |
| 4,206,401 | 6/1980 | Meyer | 324/662 |
| 4,437,055 | 3/1984 | Meyer | 324/725 |
| 4,449,179 | 12/1984 | Meyer | 324/725 |
| 4,590,461 | 5/1986 | Cooper | 340/572 |
| 4,688,026 | 8/1987 | Scribner et al. | 340/572 |
| 4,841,225 | 6/1989 | Meyer | 324/660 |
| 4,857,893 | 8/1989 | Carroll | 340/572 |
| 4,893,071 | 1/1990 | Miller | 324/660 |
| 5,019,801 | 5/1991 | Anderson, III | 340/572 |
| 5,099,228 | 3/1992 | Israel et al. | 340/572 |

*Primary Examiner*—Glen R. Swann, III

*Attorney, Agent, or Firm*—Miquel A. Valdes; Roger S. Gaither; William R. Moser

[57] ABSTRACT

A tamper-sensing system for an electronic tag 10 which is to be fixed to a surface 11 of an article 12, the tamper-sensing system comprising a capacitor having two non-contacting, capacitively-coupled elements 16, 19. Fixing of the body to the article will establish a precise location of the capacitor elements 16 and 19 relative to each other. When interrogated, the tag will generate a tamper-sensing signal having a value which is a function of the amount of capacity of the capacitor elements. The precise relative location of the capacitor elements cannot be duplicated if the tag is removed and affixed to a surrogate article having a fiducial capacitor element 19 fixed thereto. A very small displacement, in the order of 2–10 microns, of the capacitor elements relative to each other if the tag body is removed and fixed to a surrogate article will result in the tamper-sensing signal having a different, and detectable, value when the tag is interrogated.

10 Claims, 2 Drawing Sheets

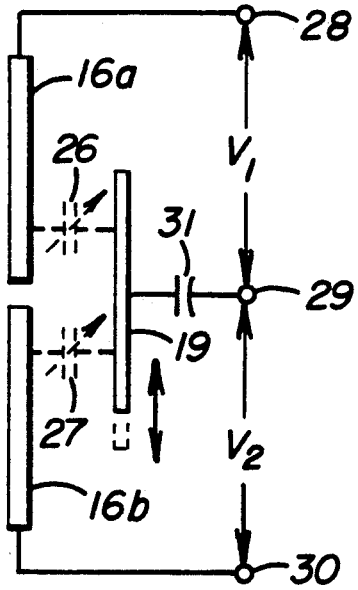
FIGURE 3
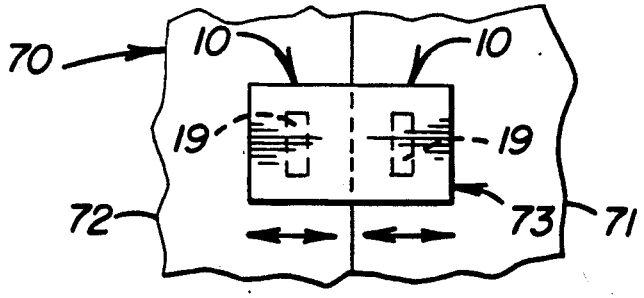
FIGURE 5
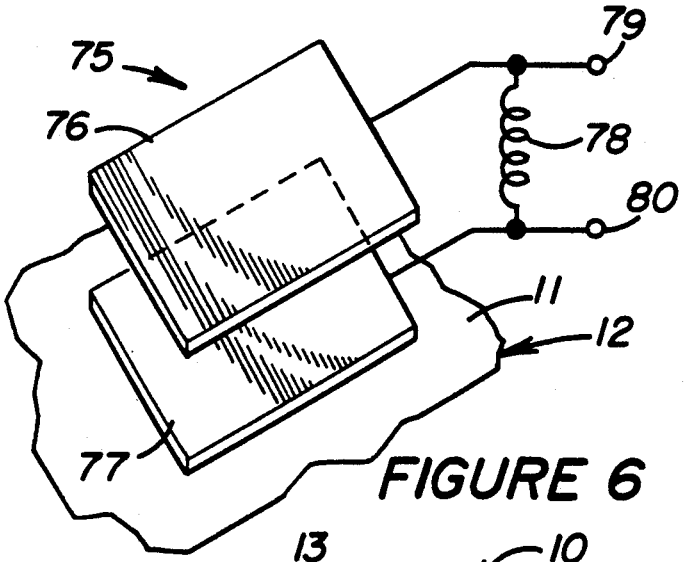
FIGURE 6
FIGURE 2
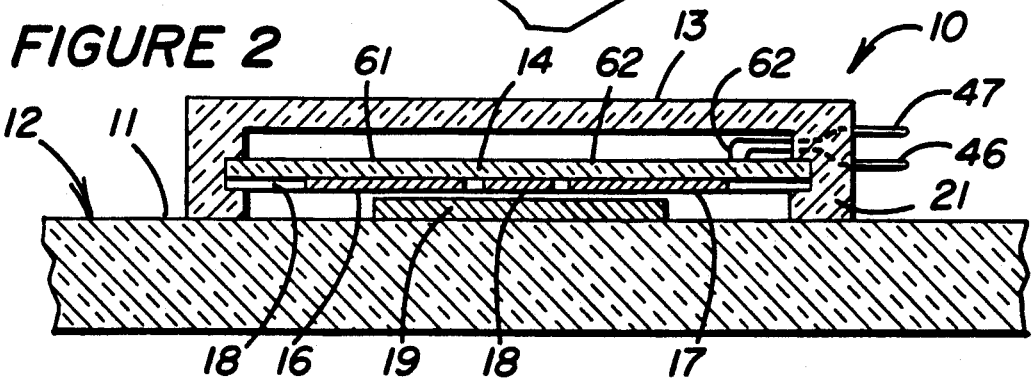
FIGURE 4
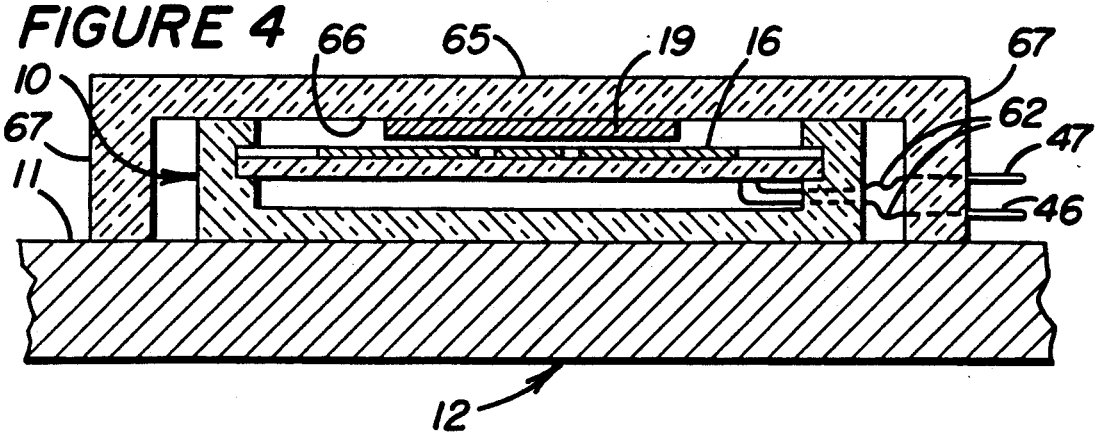

NON-CONTACT TAMPER SENSING BY ELECTRONIC MEANS

STATEMENT OF GOVERNMENT RIGHTS

The Government has rights in this invention pursuant to Contract No. W-7405-ENG-48 awarded by the United States Department of Energy.

BACKGROUND OF THE INVENTION

This invention relates to electronic tags adapted to be attached to articles and more specifically to a tamper-sensing device in a tag which senses whether the tag has been removed from one article and applied to another.

In general, an electronic tag is a device that can be affixed to a particular article to respond with digital information identifying the article when the tag is externally interrogated. Such tags are commonly used in inventory control in both commercial and governmental applications. In many instances, the tagged articles are either hidden from view or are not readily observable by the inspector. In such cases, communication channels, such as telephone lines, fiber optic cables or radio must be used to connect the tagged article with a remote inspector.

A proposed use of electronic tags is in the automotive field wherein automobiles and trucks may be tagged for automated toll collection. In such case, a vehicle passing through a toll collection station can have its tag interrogated by radio frequency signals. The tag would respond with a digital identification, such as the manufacturer's vehicle number. The toll would then be billed to the owner of the vehicle. In like manner, the owner of a fleet of vehicles could interrogate each vehicle by cellular telephone to get information about the vehicle.

For electronic tags to serve their purpose, they must remain attached to the article they are designed to identify. In many instances a person might find it very advantageous to remove the tag from one article and transfer it to a second, or surrogate, article. In such case, if the tag on the surrogate article still gave the original identification signal, the interrogator would not realize a switch had been made.

As a consequence, it is desirable that a tag have a tamper sensor that is integrated with the article to provide a unique and unvarying digital tamper-sensing signal, usually in digital form, indicating that the tag is still affixed to that article. To prevent undetected removal and fixing of the tag to a surrogate article, the tamper sensor should be designed so that if the tag is still capable of generating a tamper-sensing signal, such signal will be different than before. Thus, if the tag when interrogated responds with no tamper-sensing signal at all, or a different tamper-sensing signal, then the interrogator will know the tag has been removed from the original article.

In instances where it could be highly advantageous to remove a tag and affix it to a surrogate article, a sophisticated adversary with knowledge of the particular digital tamper-sensing signal emitted from the tag when affixed to the original article might be able to remove the tag, affix it to a surrogate and adjust the electronics of the tag so that it would again give the original tamper-sensing signal. To prevent this, the tag should be designed so that the digital value of the particular tamper-sensing signal can be known only by an authorized interrogator.

In addition, the tamper sensor should have the advantages of being small in size, easy to install, passive (i.e. not requiring internal batteries), low in maintenance, relatively inexpensive, secure against physical, chemical, x-ray or electronic attacks, with low (preferably no) false alarms, and with the ability to function as a seal for doors or the like.

SUMMARY OF THE INVENTION

It is the primary object of the invention to provide a tamper sensor for detecting the removal of an electronic tag from an article, the tamper sensor having the advantages described above.

Additional objects, advantages and novel features will be set forth in the description which follows, and in part, will become apparent to those skilled in the art upon examination of the following, or may be learned by practice of the invention. The objects and advantages of the invention may be realized and attained by means of the instrumentalities and combinations pointed out in the appended claims.

To achieve the foregoing and other objects, and in accordance with the present invention as described and claimed herein, a tamper-sensing tag is provided having a tag body adapted to be fixed against movement relative to the surface of an article, a capacitor having at least one variable capacity section with two non-contacting capacitively-coupled elements that are displaceable from each other to produce different amounts of capacity, one element being fixed to the tag body and the other element being adapted to be fixed against movement relative to said surface of the article, and means for generating a tamper-sensitive signal having a value is a function of the amount of capacity of the capacitor.

A further aspect of the invention is that the tamper-sensing signal is encrypted in the tag so that the digital value of the signal can only be known by persons with knowledge of the encryption keys.

BRIEF DESCRIPTION OF THE DRAWINGS

The accompanying drawings, which are incorporated and form part of this application, together with the description serve to explain the principles of the invention.

FIG. 2 is a lengthwise sectional view of the tag of FIG. 1 with the tag body and the fiducial element being separately fixed to an electrically non-conductive surface of an article.

FIG. 3 is a illustrative diagram to show the functioning of a differential capacitor.

FIG. 4 is a lengthwise sectional view of the tag of FIG. 1 with the tag body being fixed to an electrically conductive surface of an article and the fiducial element being fixed to a non-conductive hood which is fixed to the article.

FIG. 5 illustrates the use of a tag, constructed in accordance with the present invention, as a door seal.

FIG. 6 is a perspective view of another embodiment of the invention.

DESCRIPTION OF THE PREFERRED EMBODIMENTS

Figure 1:
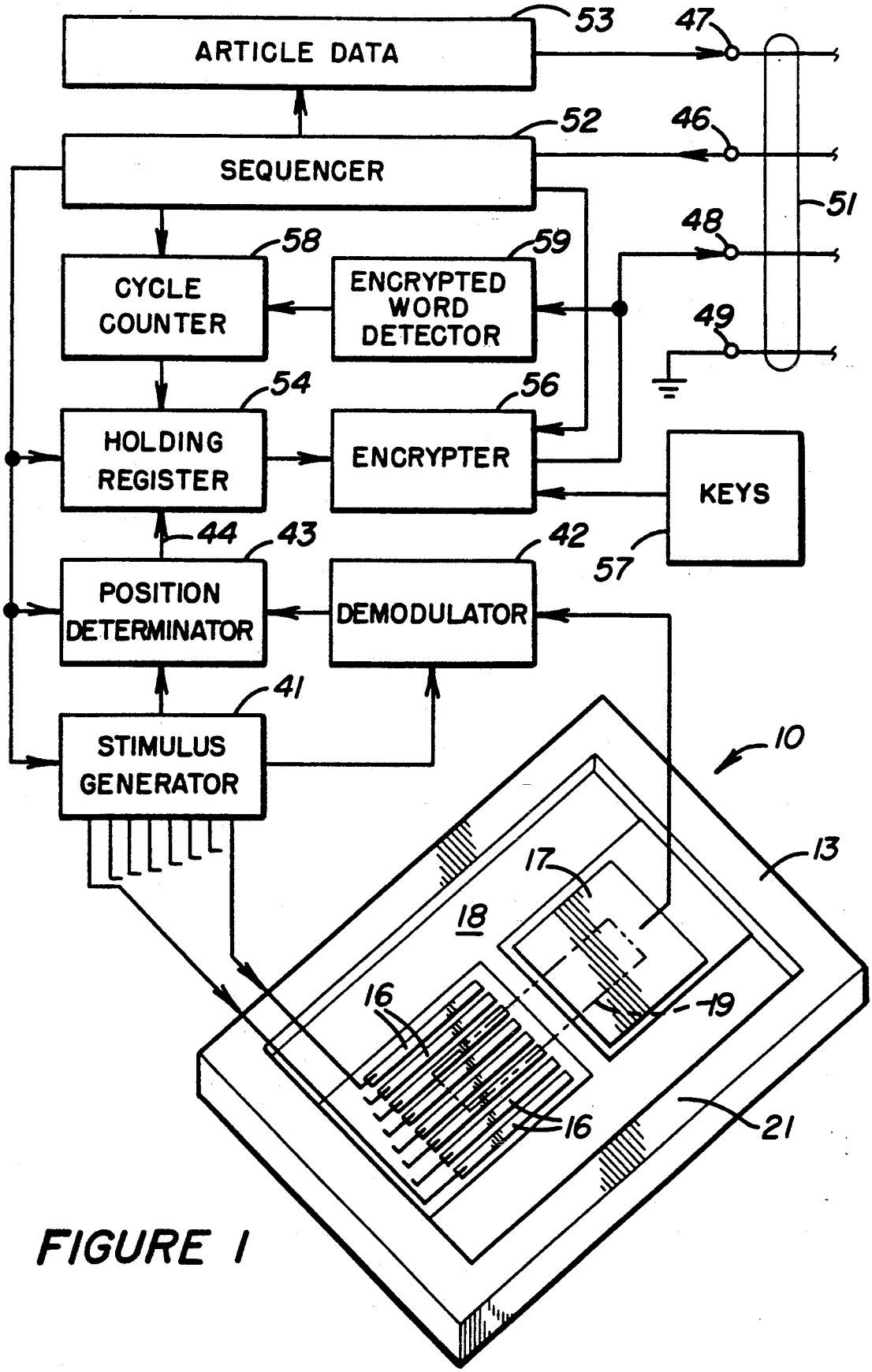
FIG. 1 is a perspective view of an electronic tag and a block diagram of the electronic components of the tag in accordance with the present invention.

Referring now to FIGS. 1 and 2, wherein a preferred embodiment of the invention is shown, the tag 10, adapted to be fixed to a surface 11 of an article 12 to be tagged, has body 13 with a non-conductive substrate 14 therewithin. Formed on one face of the substrate 14 is an array of parallel metallic transmitting electrodes, or plates 16, and a pick-up plate 17, the transmitting electrodes 16 and pick-up plate 17 being separated by a metallic ground plane 18. The tag 10 is designed to cooperate with a fiducial metallic receiving electrode, or plate, 19 fixed to the article 12. As shown in FIGS. 1 and 2, the fiducial electrode 19 has one end thereof opposed to and capacitively coupled to the array of electrodes 16 and the other end opposed to and capacitively coupled to the pick-up plate 17. Body 13 has a rim 21 around its perimeter to hold substrate 14 so that its transmitting electrodes 16 and pick-up plate 17 are closely spaced from fiducial electrode 19.

The transmitting electrodes 16 and fiducial electrode 19 form a differential capacitor, such as generally shown and described in U.S. Pat. No. 4,437,055, issued on Mar. 13, 1984 to Hans U. Meyer, in a linear capacitive measuring system, which can measure accurately a very small displacement of the electrode 19 relative to the array of electrodes 16.

FIG. 3 illustrates the basic functioning of a differential capacitor in a measuring device. As shown, the receiving electrode 19 is moveable relative to the two transmitting electrodes 16*a* and 16*b* in the direction indicated by the arrow. The elements 16*a* and 19 comprise a first variable-capacity capacitor section 26 while the elements 16*b* and 19 comprise a second variable-capacity section 27. A downward movement of electrode 19 in FIG. 3 to the dotted line position will decrease the capacity of capacitor section 26 while increasing the capacity of capacitor section 27. An alternating voltage $V_1$ is applied to terminals 28 and 29 while an alternating voltage of the same frequency but of opposite phase is applied to terminals 29 and 30. The voltages $V_1$ and $V_2$ will induce voltages in electrode 19 which are out of phase with each other. If the electrode 19 is in the position shown in solid line in FIG. 3, such that the capacity of section 26 is equal to the capacity of section 27, and the voltages $V_1$ and $V_2$ are equal in magnitude, then the net voltage induced in electrode 19 will be zero. If the electrode 19 is now moved downwardly to the dotted line position and the voltages $V_1$ and $V_2$ remain the same in magnitude, then a net voltage will be induced in electrode 19. The magnitude of this net induced voltage is detected and used to vary the voltages $V_1$ and $V_2$ so that $V_1$ increases while $V_2$ decreases in magnitude, or vice versa, so that the net voltage induced in electrode 19 returns to zero. The amplitudes of $V_1$ and $V_2$ are linear functions of the amount of displacement of electrode 19 relative to the electrodes 16*a* and 16*b*.

In FIG. 3, the electrode 19 can be connected directly to terminal 29 or can be capacitively coupled thereto, as by capacitor 31, without affecting the displacement measuring function. In FIGS. 1 and 2 the electrode 19 is capacitively coupled to the pick-up plate 17.

In the present tag, as in the above-mentioned U.S. Pat. No. 4,437,055, a stimulus generator 41 applies alternating voltages to the transmitting electrodes 16. The net voltage on electrode 19 is capacitively coupled to pick-up plate 17 and applied to the demodulator 42 together with signals from the stimulus generator 41. The output of the demodulator 42 goes to the position determinator 43, again with signals from the stimulus generator. The position determinator includes a binary up/down counter and the output 44 of the position determinator is a digital signal having, for example, 12 bits indicating with high precision the position of the fiducial electrode 19 relative to the array of electrodes 16. Commercial devices of the type just described can measure a displacement in the order of two microns of the electrode 19 relative to electrodes 16.

In the present invention, the tag housing has external terminals 46, 47, 48, 49, which will be connected to the various lines in a communication cable 51 and ultimately to a remote interrogation station (not shown). In operation, an interrogating signal will come into the tag by way of terminal 46 to initiate the operation of the sequencer 52. The sequencer can first cause the article data holding register 53 to output digital data to terminal 47 that indicates the particular identity of the tagged article. For example, the data could be the manufacturer's serial number of a tagged automobile.

The sequencer 52 will also cause the stimulus generator 41, electrodes 16 and 19, demodulator 42 and position determinator to generate a digital signal at output 44 that indicates the precise position of electrode 19 relative to the electrode array 16. In low security systems, this digital signal could be put into holding register 54 and then sent directly to output terminal 48 as a tamper-sensing signal. If the digital signal from the position determinator 43 is the same for each interrogation of the tag, then it can ordinarily be assumed that the tag is still affixed to the original article.

For higher security systems, the data should be encrypted by encrypter 56 in accordance with encryption keys 57 before the tamper sensor data is sent to the output terminal 48. The interrogation station would, of course, have the same keys so that the tamper sensor data could be decrypted. With encrypted data at output terminal 48, a person wishing to remove the tag and place it on a surrogate article would be unable to determine from the signal the particular relative location of the electrode 19 to the electrode array 26 so that the tag could be removed and installed in the same exact relation to a fiducial electrode 19 on a surrogate article.

In some instances, a very sophisticated adversary could realize that the encrypted tamper sensor date would be static, i.e. would have the same encrypted value for each interrogation. With sufficient incentive and ability, such an adversary might be able to remove the tag, place it on a surrogate article and then alter the electronics of the tag so that a signal identical to the static encrypted tamper sensor signal would be sent to the interrogation station.

To thwart this, a cycle counter 58 should be used in the tag to output binary data indicative of the count in the cycle counter into the holding register 54 that, along with the tamper sensor data from the position determinator 43. For example, with a holding register 54 that can hold 64 bits of data, 52 bits could come from the cycle counter 57 and 12 bits would come from the position determinator 43. This 64 bit word in register 54 would then be encrypted by encrypter 56 into a coded 64 bit word and sent by terminal 48 to the interrogation station. At the interrogation station the 64 bit word would then be decrypted. It would also be known at the decryption station which of the 64 bits of the decrypted word would have come from the cycle counter and which are the tamper sensor data bits.

As the encrypted 64 bit word is sent, the sending is detected by the encrypted word detector 59 and the cycle counter is advanced by one count for the next interrogation. In accordance with the present encryption technology, a change of only one of the 64 bits in register 54 will produce a substantially changed encrypted number, with the change in the encrypted number being unpredictable.

The above described elements, numbers 41–44 and 52–59, are disposed, by integrated circuit technology, on the other side 61 of substrate 14 from the mounting elements 16–18 within the tag body. Wires 62 extend through the tag body to connect the circuit with the external terminals.

In use of the tag, as shown in FIG. 2, a fiducial plate 19 is fixed to the surface 11 of article 12 at a desired location thereof. The plate 19 is electrically conductive and as inert as practicable to the environments that it will be subjected to. Gold would be the most preferred material. The plate 19 could be a separate integral piece of material that is bonded to the article 12 or it could be a painted-on electrically conductive material.

After the fiducial plate 19 has been fixed to the article, the tag body is positioned over plate 19 with plate 19 being capacitively coupled to the electrode array 16 and pick-up plate 17 so that a tamper-sensing signal will be generated when interrogated. In positioning the tag on the article it does not matter what particular value the tamper sensor signal will have, it is only necessary that there be such a signal. The tag body is then bonded to the article. After bonding the tag is interrogated and the twelve bit tamper sensing signal is then recorded by the interrogator. If some other twelve bit signal is received, then it will be known that there is now a different physical relation between the fiducial plate 19 and the electrode array 16.

In order to prevent the unauthorized and undetectable removal of the tag and replacement on a surrogate article the tag should be designed with an ability to detect very small displacements between the tag body and the fiducial plate. For example, if the electrode array 16 and fiducial plate 19 are in a first position relative to each other on a tagged article, a particular tamper-sensing signal will be produced. However, if the electrode array 16 and fiducial plate 19 are in a second, but very close, position relative to each other a different tamper-sensing signal should be produced so that the shift in relative positioning will be detected. Preferably, a different tamper-sensing signal should be produced if the relative distance between the electrode array 16 and fiducial plate 19 has been changed by no more than an amount in the range of from 2 to 10 microns. If the system operates within this range it will be extremely difficult to unbond the tag body from the article, place a same size fiducial plate on a surrogate article and then place the tag body on the new article with enough exactness that there is no more than a few microns of difference in the relative positions of the capacitor plates as compared to that of the original position. Any damage to the tag during such unbonding will, of course, increase the difficulty of trying to reestablish the original exact relation of the capacitor elements.

As mentioned above the system should preferably operate to detect a relative displacement between the capacitor elements in the range of from 2 to 10 microns. If a relative displacement of less than 2 microns is detectable the system might be too sensitive and could give error signals even if no tampering had occurred, as for example if differential thermal expansion or contraction of the tag and article occurs. On the other hand, the less the sensitivity, the easier it is to remove the tag and reinstall it relative to a fiducial plate on a surrogate article and have the same tamper-sensing signal that the tag had when on the original article. A 10 micron upper limit on the amount of displacement that can occur without detection will, in all but very high security systems, prevent the removal of a tag to a surrogate article without detection.

In the system of FIG. 2 the fiducial plate 19 is installed or formed on an electrically non-conductive surface 11 of the article 12. If the surface 11 of article is electrically conductive, then the tag 10 should be used with a non-conductive hood 65 as shown in FIG. 4. In this case the tag 10 should be fixed to article 12 with the electrode array 16 facing away from the article. The hood 65, with the fiducial plate 19 on its inner surface 66 is then placed over the tag and the apron 67 of the hood is fixed to the surface 11 of article 12. The wires 65 of tag 10 extend through hood 62 to the terminals 47–49 on the exterior of hood 61 for connection to cable 51. There must be enough clearance between rim 21 of the tag 10 and apron 67 of hood 65 so that there is a wide range of possible relative locations on the hood and tag each of which will produce a different tamper-sensing signal.

The present invention can also be used as a seal to detect tampering with containers or the like. For example, FIG. 5 shows a container 70 having a door 71 that can be opened or closed relative to the frame 72 of the container. When the door 71 is closed and tightly latched to the frame by conventional devices (not shown), fiducial plates 19 are fixed to both the door 71 and frame 72. A tag 73, which is in effect two tags 10 integrally attached to each other, is placed over the fiducial plates 19 with an electrode array 16 in opposition to each plate 19. The tag 73 is then affixed to the door and frame of the container. On interrogation, a specific tamper-sensing signal will be given by the tag. Such signal can be separate signals from each tag part or can be a single signal from each tag part or can be a single signal which is a combination of the signals from each tag part. The tag can subsequently be interrogated to see if tampering has occurred.

In the description above, the tag has been described in connection with the use of a differential capacitor. However, the present invention is not limited to use with this specific type of capacitor. For example as seen in FIG. 6, a capacitor 75 having two single plates 76 and 77 may be used, with plate 76 fixed to surface 11 of an article 12 as a fiducial plates and with plates 76 and 77 being in a partially-overlapping spaced relation. Any relative movement of the plates will, of course, change the capacitance. An inductance 78 can be connected in parallel with capacitor 75 to form a tuned circuit. A variable frequency interrogating signal on terminals 79 and 80 will cause resonance at a particular frequency depending on the values of capacitance and inductance. If there has been tampering and there is a change in the relation of the two plates 76 and 77, the frequency of oscillation will be different so that the tampering can be detected.

In the tags described above, the tamper sensing signal and the encryption parameters are independent of electrical power, and thus the tags need not have internal batteries nor need they be continually powered. Electrical power is only required when interrogating the tags. If interrogation is carried out through a cable 51 extending from the tag to the interrogating station, power can be applied to the tag from the interrogating station. If the tag is on a vehicle and interrogation is done by radio, the tag can be powered by the battery of the vehicle during interrogation. A change of battery in the vehicle will not affect operation of the tag, and its tamper sensor signal will remain the same if no tampering has occurred.

The foregoing description of the preferred embodiment has been presented for purposes of illustration and description. It is not intended to be exhaustive or to limit the invention to the precise form described, and obviously many other modifications are possible in light of the above teaching. The embodiment was chosen in order to explain most clearly the principles of the invention and its practical application thereby to enable others in the art to utilize most effectively the invention in various other embodiments and with various other modifications as may be suited to the particular use contemplated. It is intended that the scope of the invention be defined by the claims appended thereto.

I claim:

1. A tamper-sensing tag comprising:

a tag body adapted to be fixed against movement relative to a surface of an article, a capacitor having at least one variable-capacity section with first and second elements, said first element being positionable relative to said second element at various positions, displaced from each other, said one variable-capacity section having different amounts of capacity when said first element is in its various positions, respectively, relative to said second element, means for generating a first signal which is a function of the amount of capacity of said one variable-capacity section, said first signal having various values distinguishable from each other when said first element is in its various positions, respectively, relative to said second element, one of said first and second elements being fixed against movement relative to said tag body, and the other of said first and second elements being adapted to be fixed against movement relative to said surface of said article and with said first element being in a first position relative to said second element, said tag body and said other of said first and second elements being positionable relative to each other on said article prior to said tag body's being fixed to said article so as to enable said elements to be fixed to said article in said first position relative to each other, means in said tag for generating a second signal having a value unrelated to the amount of capacity of said one variable-capacity section, means in said tag for combining said first and second signals, means in said tag for encrypting said combined signals, means in said tag responsive to external interrogation of said tag for sending from said tag the encrypted combined signals in digital form, and wherein said means for generating said second signal has the function of changing the value of said second signal for each interrogation of said tag.

2. A tagged article comprising:

an article having a surface, a tag body fixed against movement relative to said surface, a capacitor having at least one variable-capacity section with first and second elements, said first element being positionable relative to said second element at various positions, displaced from each other, said one variable-capacity section having various different amounts of capacity when said first element is in its various positions, respectively, relative to said second element, means for generating a first signal which is a function of the amount of capacity of said one variable-capacity section, said first signal having various values distinguishable from each other when said first element is in its various positions, respectively, relative to said second element, one of said first and second elements being fixed against movement relative to said tag body, and the other of said first and second elements being fixed against movement relative to said surface of said article and with said first element being in a first position relative to said second element, said tag body and said other of said first and second elements being positionable relative to each other on said article prior to said tag body's being fixed to said article so as to enable said elements to be fixed to said article in said first position relative to each other, means in said tag for generating a second signal having a value unrelated to the amount of capacity of said one variable-capacity section, means in said tag for combining said first and second signals, means in said tag for encrypting said combined signals, means in said tag responsive to external interrogation of said tag for sending from said tag for encrypted combined signals in digital form, and wherein said means for generating said second signal has the function of changing the value of said second signal for each interrogation of said tag.

3. A tamper-sensing tag comprising:

a tag body adapted to be fixed against movement relative to a surface of an article, a differential capacitor having a variable-capacity section with first and second parallel elements, said first element being laterally positionable relative to said second element at various lateral positions, displaced from each other, said variable-capacity section having various different amounts of capacity when said first element is in its various lateral positions, respectively, relative to said second element, means for generating a signal which is a function of the amount of capacity of said variable-capacity section, said signal having various values distinguishable from each other when said first element is in its various positions, respectively, relative to said second element, one of said first and second elements being fixed against movement relative to said tag body, and the other of said first and second elements being adapted to be fixed against movement relative to said surface of said article and with said first element being in a first position relative to said second element, said tag body and said other of said first and second elements being laterally positionable relative to each other on said article prior to said tag body's being fixed to said article so as to enable said elements to be fixed to said article in said first lateral position relative to each other.

4. A tamper-sensing tag as set forth in claim 3 and further including:

means responsive to external interrogation of said tag for sending from said tag digital information indicative of the value of said signal of said one variable-capacity section.

5. A tamper-sensing tag as set forth in claim 3 wherein said various positions of said first element relative to said second element are distinguishable when displaced from each other in the range of from 2 to 10 microns.

6. A tamper-sensing tag as set forth in claim 3 and further including:

means in said tag for generating a second signal having a value unrelated to the amount of capacity of said one variable-capacity section, means in said tag for combining said second signal and said signal which is a function of the amount of capacity of said one variable-capacity section, means in said tag for encrypting said combined signals, means in said tag responsive to external interrogation of said tag for sending from said tag the encrypted combined signals in digital form, and wherein said means for generating said second signal has the function of changing the value of said second signal for each interrogation of said tag.

7. A tagged article comprising:

an article having a surface, a tag body fixed against movement relative to said surface, a differential capacitor having a variable-capacity section with first and second parallel elements, said first element being laterally positionable relative to said second element at various lateral positions, displaced from each other, said variable-capacity section having various different amounts of capacity when said first element is in its various lateral positions, respectively, relative to said second element, means for generating a signal which is a function of the amount of capacity of said variable-capacity section, said signal having various values distinguishable from each other when said first element is in its various positions, respectively, relative to said second element, one of said first and second elements being fixed against movement relative to said tag body, and the other of said first and second elements being fixed against movement relative to said surface of said article and with said first element being in a first position relative to said second element, said tag body and said other of said first and second elements being laterally positionable relative to each other on said article prior to said tag body's being fixed to said article so as to enable said elements to be fixed to said article in said first lateral position relative to each other.

8. A tagged article as set forth in claim 7 and further including:

means responsive to external interrogation of said tag for sending from said tag digital information indicative of the value of said signal.

9. A tagged article as set forth in claim 7 wherein said various positions of said first element relative to said second element are distinguishable when displaced from each other in the range of from 2 to 10 microns.

10. A tagged article as set forth in claim 7 and further including:

means in said tag for generating a second signal having a value unrelated to the amount of capacity of said variable-capacity section, means in said tag for combining said second signal and said signal which is a function of the amount of capacity of said variable-capacity section, means in said tag for encrypting said combined signals, means in said tag responsive to external interrogation of said tag for sending from said tag for encrypted combined signals in digital form, and wherein said means for generating said second signal has the function of changing the value of said second signal for each interrogation of said tag.

* * * * *